US005730663A

United States Patent [19]

Tanaka et al.

[11] Patent Number: 5,730,663

[45] Date of Patent: Mar. 24, 1998

[54] SOLID GOLF BALL

[75] Inventors: Hiroaki Tanaka, Kobe; Keiji Moriyama, Shirakawa, both of Japan

[73] Assignee: Sumitomo Rubber Industries, Ltd., Hyogo-ken, Japan

[21] Appl. No.: 621,342

[22] Filed: Mar. 25, 1996

[30] Foreign Application Priority Data

Mar. 27, 1995 [JP] Japan ..... 6-94335

[51] Int. Cl.[6] ..... A63B 37/06; A63B 37/12

[52] U.S. Cl. ..... 473/373; 473/374; 473/378

[58] Field of Search ..... 473/365, 373, 473/374, 378

[56] References Cited

U.S. PATENT DOCUMENTS 5,445,387 8/1995 Maruko et al. ..... 473/365 X 5,586,950 12/1996 Endo ..... 473/373 X

FOREIGN PATENT DOCUMENTS 5-4110 1/1993 Japan .

*Primary Examiner*—George J. Marlo

[57] ABSTRACT

A solid golf ball having high rebound characteristics and being superior in flight performance, durability, controllability, and shot feel which comprises a core and a cover covering the core, wherein the core has a diameter of 32.7 to 38.4 mm and a change of deformation, formed by applying to the core an initial load of 10 kg to a final load of 130 kg, of 3.5 to 6.5 mm, the cover consists of an inner layer and an outer layer in which the inner layer has a stiffness modulus of 3,500 to 6,000 kgf/cm$^2$ and a thickness of 1.1 to 2.5 mm and the outer layer has a stiffness modulus of 3,000 to 5,500 kgf/cm$^2$, which is at least 500 kgf/cm$^2$ lower than that of the inner layer, and a thickness of 1.1 to 2.5 mm, and both the inner layer and outer layer are made of a resinous composition compound mainly of an ionomer resin.

7 Claims, 1 Drawing Sheet

SOLID GOLF BALL

FIELD OF THE INVENTION

The present invention relates to a solid golf ball. More particularly, it relates to a solid golf ball having high rebound characteristics, excellent flight performance, excellent durability, good controllability and good shot feel.

BACKGROUND OF THE INVENTION

Golf balls are roughly classified into a solid golf ball and a thread wound golf ball. The solid golf ball has high rebound characteristics and is superior in flight performance and durability. The thread wound golf ball is superior in controllability and shot feel (feel when hitting).

Among the solid golf ball, a two-piece solid golf ball comprising a core and a cover covering the core is exclusively used because of its excellent flight performance and durability. However, the two-piece solid golf ball has a drawback of poor controllability and poor shot feel in comparison with the thread wound golf ball.

In order to improve the controllability of the two-piece solid golf ball, Japanese Kokoku Publication 5-4110 suggests that the cover of the golf ball is made into two layers which have different stiffness modulus with each other.

However, the method suggested by Japanese Kokoku Publication is applied to a conventionally used two-piece solid golf ball in which its cover is made relatively hard and its core is made relatively soft. The resulting golf ball is composed of a core and a two layered cover covering the core wherein hardness is made harder from the core to the outer layer cover. Accordingly, a deformation stress when hitting is concentrated at the outer layer cover because the outer layer cover is the most hard. Thus, the durability of the golf ball is lowered.

OBJECTS OF THE INVENTION

The main object of the present invention is to solve the above problems of a conventional solid golf ball, thereby providing a solid golf ball having high rebound characteristics, and being superior in flight performance, durability, controllability and shot feel.

This object as well as other objects and advantages of the present invention will become apparent to those skilled in the art from the following description with reference to the accompanying drawings.

The present invention will become more fully understood from the detailed description given hereinbelow and the accompanying drawings which are given by way of illustration only, and thus, are not limitative of the present invention, and wherein:

SUMMARY OF THE INVENTION

Figure 1:
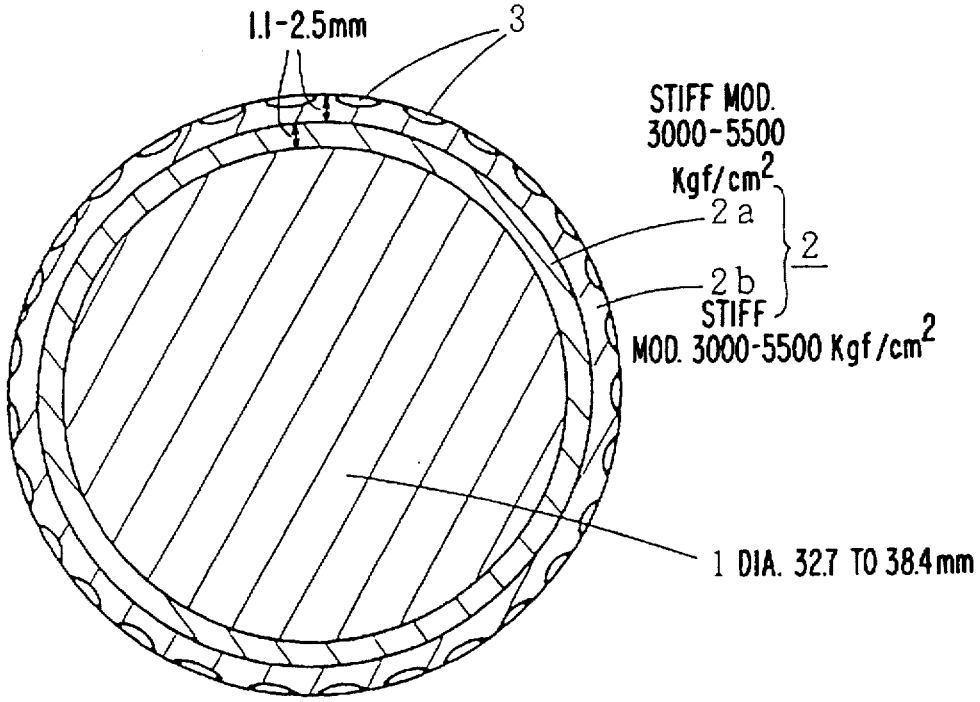
FIG. 1 is a schematic cross section illustrating one embodiment of the solid golf ball of the present invention.

The present invention provides a solid golf ball comprising a core and a cover covering the core, wherein the core has a diameter of 32.7 to 38.4 mm and a change of deformation, formed by applying an initial load of 10 kg to a final load of 130 kg to the core, of 3.5 to 6.5 mm. The cover consists of an inner layer cover and an outer layer cover in which the inner layer cover has a stiffness modulus of 3,500 to 6,000 kgf/cm$^2$ and a thickness of 1.1 to 2.5 mm and the outer layer cover has a stiffness modulus of 3,000 to 5,500 kgf/cm$^2$, which is at least 500 kgf/cm$^2$ lower than that of the inner layer cover, and a thickness of 1.1 to 2.5 mm, and both inner layer cover and outer layer cover are made of a resin composition mainly comprising an ionomer resin.

Durability is improved by using the two-layer cover and making the outer layer cover softer than the inner layer cover. Controllability is improved by making the stiffness modulus of the outer layer cover softer than that of the inner layer cover by 500 kgf/cm$^2$ or more.

DETAILED DESCRIPTION OF THE INVENTION

In the present invention, the reason why the stiffness modulus of the inner layer cover and outer layer cover is set at a specific stiffness modulus, i.e. 3,500 to 6,000 kgf/cm$^2$ and 3,000 to 5,500 kgf/cm$^2$, respectively, and the stiffness modulus of the outer layer cover is at least 500 kgf/cm$^2$ less than that of the inner layer cover, is as follows.

When the stiffness modulus of the inner layer cover is lower than 3,500 kgf/cm$^2$, the whole cover is too soft and, therefore, the durability is deteriorated. On the other hand, when the stiffness modulus of the inner layer cover exceeds 6000 kgf/cm$^2$, the feeling at the time of hitting is hard and, therefore, shot feel is inferior. In addition, when the stiffness modulus of the outer layer cover is lower than 3000 kgf/cm$^2$, the rebound characteristics are deteriorated, which results in a deterioration in the flight performance. On the other hand, when the stiffness modulus of the outer layer cover exceeds 5500 kgf/cm$^2$, the feeling at the time of hitting is hard and, therefore, shot feel is inferior. When the difference between the stiffness modulus of the inner layer cover and that of the outer layer cover is less than 500 kgf/cm$^2$, the deformation stress at the time of hitting is concentrated at the outer layer cover, which results in a deterioration of the durability.

In the solid golf ball of the present invention, the core is composed of a crosslinked molded article of a rubber composition. The diameter of the core is 32.7 to 38.4 mm. The thickness of the inner layer cover is 1.1 to 2.5 mm and that of the outer layer cover is 1.1 to 2.5 mm.

When the diameter of the core is smaller than 32.7 mm, rebound characteristics are deteriorated, which results in a deterioration of the flight performance and shot feel. On the other hand, when the diameter of the core exceeds 38.4 mm, the rebound characteristics are likely to be deteriorated, which results in deterioration of flight performance and durability.

When the thickness of the inner layer cover is smaller than 1.1 mm, rebound characteristics are deteriorated, which results in deterioration of flight performance. On the other hand, when the thickness of the inner layer cover exceeds 2.5 mm, the shot feel is inferior. In addition, when the thickness of the outer layer cover is smaller than 1.1 mm, the durability is deteriorated. On the other hand, when the thickness of the outer layer cover exceeds 2.5 mm, the shot feel is inferior.

Also, in the solid golf ball of the present invention, it is necessary that the change of deformation formed by applying a load from 10 kg (initial load) to 130 kg (final load) is 3.5 to 6.5 mm. When the change of deformation formed by applying a load from 10 kg (initial load) to 130 kg (final load) to the core is less than 3.5 mm, the shot feel is inferior because the core is hard. On the other hand, when the change of deformation formed by applying a load from 10 kg (initial load) to 130 kg (final load) to the core exceeds 6.5 mm, the rebound characteristics and durability are inferior because the core is soft.

In the solid golf ball of the present invention, when the inside of said core is measured by a JIS-C type hardness meter, the difference between the hardness at a center of the core and that of the other portions of the core is within the range of 5% or less. That is, when the core has a small difference in hardness, high rebound characteristics and excellent durability can be obtained. On the other hand, when the difference between the hardness at the center and that at the other portion of the core exceeds 5%, the rebound characteristics and durability are liable to deteriorate.

The above core is composed of a crosslinked molded article of a rubber composition obtained by formulating a metal salt of α,β-unsaturated carboxylic acid, an organic peroxide as an initiator, a filler, etc. with cis-1,4-polybutadiene or a base rubber containing cis-1,4-polybutadiene as a main component, and optionally an antioxidant, a stabilizer, etc.

The above cis-1,4-polybutadiene preferably is a so-called high-cis polybutadiene having a cis-1,4 structure of at least 40%, preferably 80% or more. The base rubber is composed of only the above cis-1,4-polybutadiene, or contains the cis-1,4-polybutadiene as the main component. The fact that the base rubber contains the cis-1,4-polybutadiene as the main component means that the base resin is prepared by mixing the above cis-1,4-polybutadiene rubber with another rubber, such as cis-1,4-polyisoprene, styrene-butadiene rubber, ethylene-propylene rubber, ethylene-propylene-diene rubber, chloroprene rubber, etc. It is preferred that the amount of the rubber other than cis-1,4-polybutadiene is not more than 10% by weight.

The metal salt of the α,β-unsaturated carboxylic acid includes one or more salts selected from metal salts of acrylic acid (e.g. zinc acrylate, magnesium acrylate, etc.) and metal salts of methacrylic acid (e.g. zinc methacrylate, magnesium methacrylate, etc.). The amount of the metal salt of the α,β-unsaturated carboxylic acid is preferably 10 to 25 parts by weight, particularly 15 to 20 parts by weight, based on 100 parts by weight of the base rubber. When the amount of the metal salt of the α,β-unsaturated carboxylic acid is less than the above range, the core is soft and the deformation amount of the core is larger than 6.5 mm, which results in a deterioration of the rebound characteristics and flight performance. On the other hand, when the amount of the metal salt of the α,β-unsaturated carboxylic acid exceeds the above range, the deformation amount of the core is smaller than 3.5 mm and the impact force at the time of hitting is large, which results in a deterioration in the shot feel.

The initiator includes organic peroxides such as dicumyl peroxide, 1,1-bis(t-butylperoxy)-3,3,5-trimethylcyclohexane, 2,5-dimethyl-2,5-di(t-butylperoxy) hexane, di-t-butyl peroxide, etc. Among them, dicumyl peroxide is particularly preferred. The amount of the initiator is preferably 0.1 to 5 parts by weight, particularly 0.3 to 3 parts by weight, based on 100 parts by weight of the base rubber. When the amount of the initiator is less than the above range, the crosslinking does not proceed sufficiently and, therefore, sufficient rebound characteristics are not obtained. On the other hand, when the amount of the initiator exceeds the above range, the crosslinking proceeds too much and the core is hard, which results in deterioration of shot feel.

Examples of the filler are zinc oxide, barium sulfate, calcium carbonate, hydrous silicate, etc. An amount of the filler is preferably 1 to 40 parts by weight, particularly 5 to 25 parts by weight, based on 100 parts by weight of the base rubber. When the amount of the filler is less than the above range, the hardness of the core is insufficient. On the other hand, when the amount of the filler exceeds the above range, the specific gravity is too large and, therefore, the rebound characteristics are liable to be deteriorated.

The core can be obtained by charging the above rubber composition in a die for the core, followed by crosslinking. The kneading condition for preparing the rubber composition for the core and crosslinking condition of the composition for core are known to persons skilled in the art, and the crosslinking is normally conducted by heating at the temperature of 140° to 180° C. under pressure for 15 to 55 minutes.

The cover (i.e. inner layer cover and outer layer cover) is formed from a resin composition containing an ionomer resin as the main component. Examples of the ionomer resin are Hi-milan 1605 (Na), Hi-milan 1706 (Zn), Hi-milan 1707 (Na), Hi-milan AM7315 (Zn), Hi-milan AM7316 (Zn), Hi-milan AM7317 (Zn), Hi-milan AM7318 (Na), Hi-milan MK7320 (K), Hi-Milan 1555 (Na) and Hi-milan 1557 (Zn) (trade name, manufactured by Mitsui Du Pont Polychemical Go., Ltd.); Surlyn 8920 (Na), Surlyn 8940 (Na), Surlyn AD8512 (Na), Surlyn 7930 (Li), Surlyn 7940 (Li), Surlyn 9910 (Zn), Surlyn AD8511 (Zn) and Surlyn 9650 (Zn) (trade name, manufactured by Du Pont Co., U.S.A.); and Iotek 7010 (Zn) and Iotek 8000 (Na) (trade name, manufactured by Exxon Chemical Co.). Na, Zn, K or Li which is shown in parenthesis following the trade name of the above ionomer resin, means neutralizing metal ion species thereof. In addition, the composition for inner layer cover and composition for outer layer cover can be prepared by appropriately formulating pigments (e.g. titanium dioxide, barium sulfate, etc.) to the above ionomer resin and optionally formulating an additive (e.g. antioxidant, fluorescent brightener, etc.). In addition, polyolefins (e.g. polyethylene, polypropylene, etc.) and polyamides may be appropriately added unless the characteristics of the ionomer resin are damaged. It is preferred that the amount of the resin to be added is not more than 10% by weight based on the total amount.

A method of covering the inner layer cover and outer layer cover is not specifically limited, but may be a normal method which is used for covering the cover. For example, when the inner layer cover is covered on the core, there can be used a method comprising molding a composition for the inner layer cover into a semi-spherical half-shell in advance, covering a core with two half-shells and then subjecting it to pressure molding at 100° to 170° C. for 1 to 15 minutes, or a method comprising injection molding the composition for the inner layer cover directly on the core to cover the core. In addition, the outer layer cover can be covered on the inner layer cover in the same manner as that of covering the inner layer cover on the core.

One embodiment of the solid golf ball of the present invention will be explained with reference to the accompanying drawing. FIG. 1 is a schematic cross section illustrating one embodiment of the solid golf ball of the present invention. In FIG. 1, 1 is a core, 2 is a cover covering the core. The cover 2 is composed of an inner layer cover 2*a* and an outer layer cover 2*b*. Dimples 3 are provided on the outer layer cover 2*b*.

The core 1 is composed of a crosslinked molded article of a rubber composition which is referred to as a so-called "solid core". The core 1 has a diameter of 32.7 to 38.4 mm and an amount of deformation, formed by applying a load from 10 kg (initial load) to 130 kg (final load) to the core, of 3.5 to 6.5 mm. In addition, it is preferred that the internal hardness of the core 1 is a hardness measured by a JIS-C type hardness meter and the difference between the hardness at the center part and that at the part other than the center part is not more than 5%.

The inner layer cover 2a is composed of a resin composition having a stiffness modulus of 3,500 to 6,000 kgf/cm$^2$. The inner layer cover 2a is composed of a resin composition containing an ionomer resin as a main component, and the thickness is 1.1 to 2.5 mm.

The outer layer cover 2b is composed of a resin composition having a stiffness modulus of 3,000 to 5,500 kgf/cm$^2$, which is at least 500 kgf/cm$^2$ lower than that of the inner layer cover. The outer layer cover 2b is composed of a resin composition containing an ionomer resin as a main component, and the thickness is 1.1 to 2.5 mm.

A suitable number of dimples 3 may be optionally provided in an appropriate arrangement so as to obtain the desired characteristics. Also, painting, marking, etc. may be optionally provided on the surface of the golf ball.

As described above, the present invention could provide a solid golf ball having high rebound characteristics, which is superior in flight performance, durability, controllability and shot feel.

EXAMPLES

The following Examples and Comparative Examples further illustrate the present invention in detail but am not to be construed to limit the scope thereof.

Examples 1 to 5 and Comparative Examples 1 to 5

A composition for core was prepared according to the formulations shown in Tables 1 and 2 and the resulting composition for core was charged in a die for core and crosslinked and molded at 165° C. for 25 minutes to prepare a core, respectively. The diameter, deformation amount and hardness of the resulting core were measured. The results are shown in Tables 1 and 2. Further, the unit of the amount of the respective components to be formulated is "parts by weight", and the same may be said of the tables showing the formulation described hereinafter. The deformation amount of the core was determined by measuring the amount of deformation formed by applying a load from 10 kg (initial load) to 130 kg (final load) to the core. The hardness of the core is measured at the center of the core, position which is 5 mm away from the center to surface, position which is 10 mm away from the center to surface, position which is 15 mm away from the center to surface, and surface, using a JIS-C type hardness tester. Further, the hardness of the interior of the core was determined by cutting the core into halves, followed by measuring at the predetermined position, respectively.

The core formulation, diameter of the core, deformation amount of the core and hardness of the core of Examples 1 to 5 are shown in Table 1. Those of Comparative Examples 1 to 5 are shown in Table 2. Further, those represented by the trade name will be shown in detail, following Table 2.

TABLE 1

| | Example No. | | | | |
|---|---|---|---|---|---|
| | 1 | 2 | 3 | 4 | 5 |
| Core formulation: | | | | | |
| JSR BR-11 ※1 | 100 | 100 | 100 | 100 | 100 |
| Zinc acrylate | 26 | 26 | 26 | 26 | 26 |
| Dicumyl peroxide | 1 | 1 | 1 | 1 | 1 |
| Zinc oxide | 32.8 | 32.8 | 32.8 | 29.1 | 29.1 |
| Diameter of core (mm) | 35.1 | 35.1 | 35.1 | 36.3 | 36.3 |
| Deformation amount of core (mm) | 4.335 | 4.335 | 4.335 | 4.300 | 4.300 |
| Hardness of core: | | | | | |
| Center | 71.3 | 71.3 | 71.3 | 71.0 | 71.0 |
| Position which is 5 mm away from the center | 69.5 | 69.5 | 69.5 | 70.5 | 70.5 |
| Position which is 10 mm away from the center | 69.3 | 69.3 | 69.3 | 69.5 | 69.5 |
| Position which is 15 mm away from the center | 69.0 | 69.0 | 69.0 | 70.0 | 70.0 |
| Surface | 67.9 | 67.9 | 67.9 | 69.5 | 69.5 |

TABLE 2

| | Comparative Example No. | | | | |
|---|---|---|---|---|---|
| | 1 | 2 | 3 | 4 | 5 |
| Core formulation: | | | | | |
| JSR BR-11 ※1 | 100 | 100 | 100 | 100 | 100 |
| Zinc acrylate | 26 | 26 | 26 | 26 | 26 |
| Dicumyl peroxide | 1 | 1 | 1 | 1 | 1 |
| Zinc oxide | 32.8 | 32.8 | 32.8 | 32.8 | 32.8 |
| Diameter of core (mm) | 35.1 | 35.1 | 35.1 | 35.1 | 35.1 |
| Deformation amount of core (mm) | 4.335 | 4.335 | 4.335 | 4.335 | 4.335 |
| Hardness of core: | | | | | |
| Center | 71.3 | 71.3 | 71.3 | 71.3 | 71.3 |
| Position which is 5 mm away from the center | 69.5 | 69.5 | 69.5 | 69.5 | 69.5 |
| Position which is 10 mm away from the center | 69.3 | 69.3 | 69.3 | 69.3 | 69.3 |
| Position which is 15 mm away from the center | 69.0 | 69.0 | 69.0 | 69.0 | 69.0 |
| Surface | 67.9 | 67.9 | 67.9 | 67.9 | 67.9 |

※1: JSR BR01 (trade name)

High-cis polybutadiene having 96% of a cis-1,4 structure, manufactured by Japan Synthetic Rubber Co., Ltd.

Then, a composition for inner layer cover and a composition for outer layer cover composition were prepared according to the formulations shown in Tables 3 and 4. The formulations of the inner layer cover and outer layer cover of Examples 1 to 5 are shown in Table 3, and those of Comparative Examples 1 to 5 are shown in Table 4. Further, the ionomer resin is represented by the trade name but the details will be shown, following Table 4. In addition, the formulations shown in Tables 3 and 4 shows only the resin components, and the composition for inner layer cover and composition for outer layer cover respectively contain titanium dioxide in the amount of 2 parts by weight based on 100 parts by weight of the resin component.

TABLE 3

| | | Example No. | | | | |
|---|---|---|---|---|---|---|
| | | 1 | 2 | 3 | 4 | 5 |
| Inner layer cover formulation (resin component): | | | | | | |
| Hi-milan 1706 | ·X·2 | 0 | 30 | 0 | 0 | 0 |
| Hi-milan 1707 | ·X·3 | 0 | 30 | 0 | 0 | 0 |
| Hi-milan 1605 | ·X·4 | 0 | 40 | 0 | 0 | 0 |
| Iotek 8000 | ·X·5 | 50 | 0 | 50 | 50 | 70 |
| Hi-milan 7315 | ·X·6 | 50 | 0 | 50 | 50 | 30 |
| Outer layer cover formulation (resin component): | | | | | | |
| Hi-milan 1706 | ·X·2 | 30 | 50 | 40 | 30 | 0 |
| Hi-milan 1707 | ·X·3 | 30 | 0 | 30 | 30 | 0 |
| Hi-milan 1605 | ·X·4 | 40 | 50 | 30 | 40 | 0 |
| Iotek 8000 | ·X·5 | 0 | 0 | 0 | 0 | 50 |
| Hi-milan 7315 | ·X·6 | 0 | 0 | 0 | 0 | 50 |

TABLE 4

| | | Comparative Example No. | | | | |
|---|---|---|---|---|---|---|
| | | 1 | 2 | 3 | 4 | 5 |
| Inner layer cover: | | | | | | |
| Hi-milan 1706 | ·X·2 | 50 | 0 | 30 | 0 | 30 |
| Hi-milan 1707 | ·X·3 | 0 | 0 | 30 | 0 | 30 |
| Hi-milan 1605 | ·X·4 | 50 | 0 | 40 | 0 | 40 |
| Iotek 8000 | ·X·5 | 0 | 30 | 0 | 30 | 0 |
| Hi-milan 7315 | ·X·6 | 0 | 30 | 0 | 30 | 0 |
| Nylon 12 | | 0 | 40 | 0 | 40 | 0 |
| Outer layer cover: | | | | | | |
| Hi-milan 1706 | ·X·2 | 30 | 40 | 30 | 0 | 30 |
| Hi-milan 1707 | ·X·3 | 0 | 30 | 0 | 0 | 30 |
| Hi-milan 1605 | ·X·4 | 40 | 30 | 40 | 0 | 40 |
| Iotek 8000 | ·X·5 | 0 | 0 | 30 | 0 | 0 |
| Hi-milan 7315 | ·X·6 | 0 | 0 | 0 | 30 | 0 |
| Hi-milan 1855 | ·X·7 | 30 | 0 | 30 | 0 | 0 |
| Nylon 12 | | 0 | 0 | 0 | 40 | 0 |

·X·2: Hi-milan 1706 (trade name):

ethylene-methacrylic acid copolymer ionomer resin obtained by neutralizing with a zinc ion, manufactured by Mitsui Du Pont Polychemical Co., stiffness modulus: about 2600 kg/cm$^2$ ·X·3: Hi-milan 1707 (trade name):

ethylene-methacrylic acid copolymer ionomer resin obtained by neutralizing with a sodium ion, manufactured by Mitsui Du Pont Polychemical Co., stiffness modulus: about 3800 kg/cm$^2$ ·X·4: Hi-milan 1605 (trade name):

ethylene-methacrylic acid copolymer ionomer resin obtained by neutralizing with a sodium ion, manufactured by Mitsui Du Pont Polychemical Co., stiffness modulus: about 3100 kg/cm$^2$ ·X·5: Iotek 8000 (trade name):

ethylene-acrylic acid copolymer ionomer resin obtained by neutralizing with a sodium ion, manufactured by Exxon Chemical Co., stiffness modulus: about 4000 kg/cm$^2$ ·X·6: Hi-milan AM7315 (trade name):

ethylene-methacrylic acid copolymer ionomer resin obtained by neutralizing with a zinc ion, manufactured by Mitsui Du Pont Polychemical Co., stiffness modulus: about 4500 kg/cm$^2$ ·X·7: Hi-milan 1855 (trade name):

ethylene-methacrylic acid-acrylate three-dimensional copolymer ionomer resin obtained by neutralizing with a zinc ion, manufactured by Mitsui Du Pont Polychemical Co., stiffness modulus: about 900 kg/cm$^2$ The stiffness modulus of the resin composition for inner layer cover and the resin composition for outer layer cover prepared as described above was shown in Tables 5 and 6. Further, the stiffness modulus was measured at 23° C. using a stiffness modulus tester manufactured by Toyo Seiki Co., Ltd. according to ASTM D-747. A sample for measuring the stiffness modulus was respectively made by subjecting the above resin composition for the inner layer cover and the resin composition for the outer layer cover to hot press molding to form a plate having a thickness of about 2 mm, followed by standing at 23° C. and a relative humidity of 50% for 2 weeks. The resulting sample was used for the measurement.

Then, the resin composition for inner layer cover was injection-molded on the core to form an inner layer cover. The resin composition for the outer layer cover was injection-molded on the inner layer cover to form an outer layer cover. Thus, a solid golf ball having an outer diameter of 42.7 mm and a ball weight of 45.4 g was produced.

The ball weight, ball deformation amount, rebound coefficient, flying distance (carry), spin amount, durability and shot feel of the resulting golf ball were examined. The results are shown in Tables 5 and 6.

The measuring method or evaluation method of the above ball deformation amount, rebound coefficient, flying distance (carry), spin amount, durability and shot feel is as follows.

Ball deformation change

The change of deformation formed by applying a load from 10 kg (initial load) to 130 kg (final load) to a golf ball is measured.

Rebound coefficient:

A metal cylinder (198.4 g) was struck against a golf ball at a speed of 45 m/second using a R & A (British Golf Association) initial velocity measuring device to measure a ball speed, and then the rebound coefficient was calculated from the ball speed.

Flight distance:

A No. 1 wood club was mounted to a Swing robot manufactured by True Temper Co., and then a golf ball was hit at a head speed of 45 m/second to measure a distance to a dropping point as the flight distance (carry).

Spin amount:

A pitching wedge was mounted to a Swing robot manufactured by True Temper Co., and then a golf ball was hit with a head speed of 20 m/second. The photograph of the hit golf ball was continuously taken to determine the spin amount.

Durability:

A golf ball was struck against a metal plate ball at a speed of 45 m/second using an air gun, and then the number of times until breakage was arisen was measured. The resulting value was indicated as an index in case of the value of the golf ball of Example 1 being 100.

Shot feel:

It is evaluated by hitting a golf ball with a No. 1 wood club due to 10 top professional golfers. The evaluation criteria are as follows. The results shown in Tables below are based on the fact that not less than 8 out of 10 professional golfers evaluated with the same criterion about each test item.

Evaluation criteria
○: Excellent
Δ: Ordinary
X: Worse
XX: Worst

TABLE 5

| | Example No. | | | | |
|---|---|---|---|---|---|
| | 1 | 2 | 3 | 4 | 5 |
| ① Inner layer cover: | | | | | |
| Stiffness moduius (kg/cm²) | 4800 | 4000 | 4800 | 4800 | 5500 |
| Thickness (mm) | 1.9 | 1.9 | 1.9 | 1.6 | 1.6 |
| ② Outer layer cover: | | | | | |
| Stiffness modulus (kg/cm²) | 4000 | 3000 | 3600 | 4000 | 4800 |
| Thickness (mm) | 1.9 | 1.9 | 1.9 | 1.6 | 1.6 |
| ①-② (kg/cm²) | 1000 | 800 | 1200 | 800 | 700 |
| Ball deformation change (mm) | 2.4 | 2.8 | 2.5 | 2.4 | 2.1 |
| Rebound coefficient | 0.792 | 0.780 | 0.786 | 0.795 | 0.806 |
| Flight distance (yard) | 231.5 | 231.2 | 230.8 | 231.3 | 231.2 |
| Spin amount (rpm) | 4500 | 5000 | 4800 | 4900 | 4500 |
| Durability (index) | 100 | 120 | 115 | 105 | 110 |
| Shot feel | ○ | ○ | ○ | ○ | ○ |

TABLE 6

| | Comparative Example No. | | | | |
|---|---|---|---|---|---|
| | 1 | 2 | 3 | 4 | 5 |
| ① Inner layer cover: | | | | | |
| Stiffness modulus (kg/cm²) | 3000 | 6500 | 4000 | 6500 | 4000 |
| Thickness (mm) | 1.9 | 1.9 | 1.9 | 1.9 | 1.9 |
| ② Outer layer cover: | | | | | |
| Stiffness modulus (kg/cm²) | 2000 | 3600 | 2000 | 6500 | 4000 |
| Thickness (mm) | 1.9 | 1.9 | 1.9 | 1.9 | 1.9 |
| ①-② (kg/cm²) | 1000 | 2900 | 2000 | 0 | 0 |
| Ball deformation amount (mm) | 3.0 | 2.2 | 2.9 | 1.8 | 2.7 |
| Rebound coefficient | 0.745 | 0.755 | 0.745 | 0.760 | 0.760 |
| Flight distance (yard) | 226.1 | 227.2 | 225.2 | 227.3 | 227.0 |
| Spin amount (rpm) | 5800 | 4500 | 5000 | 4000 | 4200 |
| Durability (index) | 70 | 80 | 80 | 80 | 70 |
| Shot feel | Δ | XX | X | XX | Δ |

As is apparent from a comparison between ball characteristics of Examples 1 to 5 shown in Table 5 and those of Comparative Examples 1 to 5 shown in Table 6, the golf balls of Examples 1 to 5 had high rebound performance because of large rebound coefficient. In addition, they were superior in flight performance (because of large flight distance), durability (because of large index indicating the durability), controllability (because of large spin amount) and shot feel.

The formulation of the core of the golf balls of Examples 1 to 5 is the same as that of the golf balls of Comparative Examples. In addition, the diameter and deformation amount of the core are the same except for the golf balls of Examples 4 and 5. The golf balls of Examples 1 to 5 has high rebound performance and were superior in flight performance, durability, controllability and shot feel, because the stiffness modulus of the inner layer cover and outer layer cover was specified to a specific stiffness modulus.

To the contrary, the golf ball of Comparative Example 1 was inferior in rebound characteristics, flight distance and durability, because the stiffness modulus of the inner layer cover and the outer layer cover was low. The golf ball of Comparative Example 2 was particularly inferior in shot feel, because the stiffness modulus of the inner layer cover was too high.

The golf ball of Comparative Example 3 was inferior in rebound characteristics, flight distance and durability, because the stiffness modulus of the outer layer cover was low. The golf ball of the Comparative Example 4 was particularly inferior in shot feel, because the stiffness modulus of the inner layer cover and outer layer cover was too high. The golf ball of the Comparative Example 5 was particularly inferior in durability, because there is no difference between the stiffness modulus of the inner layer cover and that of the outer layer cover.

Comparative Examples 6 to 11

A composition for core was prepared according to the formulation shown in Table 7, and then the resulting composition for the core was charged in a die for the core and crosslinked and molded at 165° C. for 25 minutes to produce a core.

The diameter, deformation amount and hardness (measured by JIS-C type hardness tester) of the resulting core were measured in the same manner as that described in Example 1. The results are shown in Table 7. The materials used for the formulation of the core are the same as those used in Example 1, and they were represented by the trade name.

TABLE 7

| | Comparative Example No. | | | | | |
|---|---|---|---|---|---|---|
| | 6 | 7 | 8 | 9 | 10 | 11 |
| Core formulation: | | | | | | |
| JSR BR-11 ※1 | 100 | 100 | 100 | 100 | 100 | 100 |
| Zinc acrylate | 35 | 10 | 26 | 26 | 26 | 26 |
| Dicumyl peroxide | 1 | 1 | 1 | 1 | 1 | 1 |
| Zinc oxide | 30.0 | 37.7 | 47.1 | 27.4 | 27.4 | 23.0 |
| Diameter of core (mm) | 35.1 | 35.1 | 31.7 | 36.9 | 36.9 | 38.7 |
| Deformation amount of core (mm) | 3.343 | 6.600 | 4.506 | 4.412 | 4.412 | 4.621 |
| Hardness of core: | | | | | | |
| Center | 76.0 | 60.0 | 70.0 | 70.0 | 70.0 | 70.0 |
| Position which is 5 mm away from the center | 75.5 | 60.0 | 69.5 | 69.0 | 69.0 | 69.0 |
| Position which is 10 mm away from the center | 75.5 | 59.5 | 69.0 | 69.5 | 69.5 | 69.0 |
| Position which is 15 mm away from the center | 76.5 | 60.5 | 69.0 | 69.0 | 69.0 | 68.5 |
| Surface | 76.5 | 60.5 | 69.5 | 69.5 | 69.5 | 68.5 |

A composition for the inner layer cover and the composition for the outer layer cover were prepared according to the formulations shown in Table 8. According to the manner described in Example 1, the above core was coated with the composition for the inner layer cover to form an inner layer cover which was coated with the composition for the outer layer cover to form an outer layer cover. Thus, a solid golf ball having an outer diameter of 42.7 mm and a ball weight of 45.4 g was produced. Further, the ionomer resin used for the cover was the same as that used in Examples 1 to 5 and Comparative Example 5, and was represented by the trade name.

The ball deformation amount, rebound coefficient, flight distance (yard), spin amount, durability and shot feel of the resulting golf ball were examined in the same manner as that described in Example 1. The results are shown in Tables 9 and 10. In addition, the stiffness modulus and thickness of the inner layer cover and outer layer cover, which were measured in the same manner as that described in Example 1, are also shown in Tables 9 and 10.

TABLE 8

| | Comparative Example No. | | | | | |
|---|---|---|---|---|---|---|
| | 6 | 7 | 8 | 9 | 10 | 11 |
| Inner layer cover formulation (resin component): | | | | | | |
| Iotek 8000 | 50 | 50 | 50 | 50 | 50 | 50 |
| Hi-milan 7315 | 50 | 50 | 50 | 50 | 50 | 50 |
| Outer layer cover formulation (resin component): | | | | | | |
| Hi-milan 1706 | 30 | 30 | 30 | 30 | 30 | 30 |
| Hi-milan 1707 | 30 | 30 | 30 | 30 | 30 | 30 |
| Hi-milan 1605 | 40 | 40 | 40 | 40 | 40 | 40 |

TABLE 9

| | Comparative Example No. | |
|---|---|---|
| | 6 | 7 |
| ① Inner layer cover: | | |
| Stiffness modulus (kg/cm$^2$) | 4800 | 4800 |
| Thickness (mm) | 1.9 | 1.9 |
| ② Outer layer cover: | | |
| Stiffness modulus (kg/cm$^2$) | 4000 | 4000 |
| Thickness (mm) | 1.9 | 1.9 |
| ①-② (kg/cm$^2$) | 800 | 800 |
| Ball deformation change (mm) | 2.2 | 3.3 |
| Rebound coefficient | 0.760 | 0.750 |
| Flight distance (yard) | 227.0 | 226.5 |
| Spin amount (rpm) | 4500 | 4300 |
| Durability (index) | 70 | 30 |
| Shot feel | XX | X |

TABLE 10

| | Comparative Example No. | | | |
|---|---|---|---|---|
| | 8 | 9 | 10 | 11 |
| ① Inner layer cover: | | | | |
| Stiffness modulus (kg/cm$^2$) | 4800 | 4800 | 4800 | 4800 |
| Thickness (mm) | 2.75 | 1.0 | 1.9 | 1.0 |
| ② Outer layer cover: | | | | |
| Stiffness modulus (kg/cm$^2$) | 4000 | 4000 | 4000 | 4000 |
| Thickness (mm) | 2.75 | 1.9 | 1.0 | 1.0 |
| ①-② (kg/cm$^2$) | 800 | 800 | 800 | 800 |
| Ball deformation amount (mm) | 1.7 | 2.9 | 3.0 | 3.2 |
| Rebound coefficient | 0.760 | 0.755 | 0.750 | 0.740 |
| Flight distance (yard) | 226.8 | 226.7 | 226.3 | 226.4 |
| Spin amount (rpm) | 3800 | 4000 | 4400 | 4600 |

TABLE 10-continued

| | Comparative Example No. | | | |
|---|---|---|---|---|
| | 8 | 9 | 10 | 11 |
| Durability (index) | 100 | 80 | 40 | 20 |
| Shot feel | XX | X | Δ | X |

As is apparent from the results shown in Tables 9 and 10, the golf balls of Comparative Examples were inferior in one or more characteristics of flight distance, durability, controllability and shot feel (e.g. small flight distance, etc.).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A solid golf ball comprising a core and a cover covering said core, wherein the core has a diameter of 32.7 to 38.4 mm and a change of deformation, formed by applying to the core an initial load of 10 kg and a final load of 130 kg, of 3.5 to 6.5 mm, and the cover consists of an inner layer and an outer layer, said inner layer of the cover having a stiffness modulus of 3,500 to 6,000 kgf/cm$^2$ and a thickness of 1.1 to 2.5 mm and the outer layer cover having a stiffness modulus of 3,000 to 5,500 kgf/cm$^2$, in which the stiffness modulus of the outer layer is at least 500 kgf/cm$^2$ lower than that of the inner layer, and a thickness of 1.1 to 2.5 mm, and wherein both the inner layer cover and outer layer cover are made of a resinous composition comprised mainly of an ionomer resin.

2. The solid golf ball according to claim 1, wherein when the inside of said core is measured by a JIS-C type hardness meter, the difference between the hardness of the center of the core and that of the other portions of the core is within the range of 5% or less.

3. The solid golf ball according to claim 1, wherein the core is composed of a base rubber comprising at least 80% cis-1,4-polybutadiene.

4. The solid golf ball according to claim 3, wherein the amount of the base rubber other than cis-1,4-polybutadiene is not more than 10% by weight.

5. The solid golf ball according to claim 1, wherein the core contains 10 to 25 parts by weight of a metal salt of an α,β-unsaturated carboxylic acid based on 100 parts by weight of the base rubber.

6. The solid golf ball according to claim 5, wherein the core contains an organic peroxide in an amount of 0.1 to 5 parts by weight based on 100 parts by weight of the base rubber.

7. The solid golf ball according to claim 6, wherein the core contains a filler in an amount of 1 to 40 parts by weight based on 100 parts by weight of the base rubber.

* * * * *